United States Patent [19]

Audeh et al.

[11] Patent Number: 4,518,480

[45] Date of Patent: May 21, 1985

[54] PROCESS FOR THE EFFICIENT UTILIZATION OF SOLVENT MODIFIED OIL SHALES

[75] Inventors: Costandi A. Audeh, Princeton; Thomas O. Mitchell, Trenton, both of N.J.

[73] Assignee: Mobil Oil Corporation, New York, N.Y.

[21] Appl. No.: 626,845

[22] Filed: Jul. 2, 1984

[51] Int. Cl.[3] ..... C10G 1/04

[52] U.S. Cl. ..... 208/11 LE

[58] Field of Search ..... 208/11 LE, 8 LE

[56] References Cited

U.S. PATENT DOCUMENTS 2,642,380 6/1933 Horne et al. ..... 208/11 LE
2,847,306 8/1958 Stewart et al. ..... 208/11 LE
3,779,902 12/1973 Mitchell et al. ..... 208/11 LE
4,036,732 7/1977 Irani et al. ..... 208/11 LE

FOREIGN PATENT DOCUMENTS 816689 7/1969 Canada ..... 208/11 LE

*Primary Examiner*—D. E. Gantz
*Assistant Examiner*—A. Pal
*Attorney, Agent, or Firm*—A. J. McKillop; C. J. Speciale; C. A. Malone

[57] ABSTRACT

A combination process for the treatment of oil shale to recover hydrocarbonaceous material therefrom comprising the steps of solvent treating said oil shale, sequentially solvent extracting said treated oil shale, hydrotreating the extracts and processing any carbon remaining on said oil shale to recover heat or gas values therefrom.

48 Claims, No Drawings

PROCESS FOR THE EFFICIENT UTILIZATION OF SOLVENT MODIFIED OIL SHALES

FIELD OF INVENTION

This invention is directed to a process for solvent treating oil shale and hydroprocessing the asphaltenic residuum to obtain increased yields of hydrocarbonaceous materials from said oil shale.

BACKGROUND OF INVENTION

Oil shales, particularly the Devonian-like shales of the Eastern United States contain organic carbon equal in amount to that contained in the Western shale of the Green River formation. However, upon retorting by the usual processes, Eastern shales yield smaller amounts of oil or hydrocarbonaceous material than the Western shales.

Several procedures have been proposed to enhance the yield of oil from Eastern shales. Previously known technologies relating to the recovery of organic material from rock, such as kerogen from oil shale, rely principally upon either thermal means or the use of molecular hydrogen and treat the rock in a substantially dry state, i.e., in the absence of any significant amount of liquid. See, for example, DT-OS No. 2,806,806 to Kraftwerk Union AG and The IGT Hytort Process for Hydrogen Retorting of Devonian Oil Shales by S. A. Weil at al., a paper dated Nov. 14, 1978 and presented at The Chattanooga Shale Conference. Such processes require the system transport of essentially dry rock and/or require the extensive use of inherently dangerous hydrogen gas.

Green et al., in U.S. Pat. No. 4,325,803 disclosed a method for removing organic material from oil bearing rock. According to the invention, rock containing organic material was contacted with a hydrogen transfer agent which was liquid at standard conditions by forming a slurry of the rock to be treated and a liquid comprising such a hydrogen transfer agent. In a preferred embodiment of the invention, rock containing the organic material to be separated, such as oil shale, was pulverized, preheated via contacting with hot recycle vapors and slurried with a liquid comprising a hydrogen transfer agent. The slurry was then reacted at elevated temperature and pressure and the product of the reaction flashed.

Patzer in U.S. Pat. No. 4,238,315 issued Dec. 9, 1980 disclosed another process for obtaining oil from oil shale. In his process oil was recovered from oil shale and a solvent at a temperature in the range of about 385° to about 440° C. and a pressure in the range of about 250 to about 2,000 pounds per square inch gauge (about 1.72 MPa to about 13.8 MPa) for a period of about 20 minutes to about two hours and thereafter recovering the resulting oil.

It has been observed when a H-donor solvent is used to modify an oil shale, a material is formed that is soluble in a variety of solvents. Prior to H-donor treatment, little or no solubility is possible. It has also been observed that not all solvents dissolve all the modified organic product. For example, it has been observed that whereas normal n-heptane dissolves about 50–70% by weight of the organic product of H-donor treatment, pyridine dissolves 100% by weight.

Therefore, what is needed is a process which will provide for the sequential selective solvent extraction of modified organic product remaining on H-donor treated oil shale, and a hydrogenation of extracted products to improve the efficiency and yield of products of oil shale, particularly Eastern oil shale.

SUMMARY

This invention is directed to a combination process for removing hydrocarbonaceous materials from oil shale. To accomplish this, the oil shale is treated with a hydrogen donor solvent. The oil shale is then subjected to selective paraffinic solvent extraction which solubilizes some hydrocarbonaceous materials and leaves on said shale residual carbon and a modified residue, hereinafter referred to as "solvent or paraffinic asphaltenes."

Upon completion of the solubilization step, the oil shale is separated from the paraffinic solvent containing solubilized hydrocarbonaceous material. Afterwards, the solvent may be either separated from the solubilized hydrocarbonaceous material or used with said hydrocarbonaceous material as a hydrogen donor solvent, with or without hydroprocessing.

Next, the oil shale is subjected to another solvent extraction step to remove the "paraffinic asphaltenes." A solvent is selected dependent upon the nature of the "paraffinic asphaltenes." For this purpose, an oil fraction or oil fraction separated from the solubilized hydrocarbonaceous material in the paraffinic solvent can be used. A nitrogen containing polar fraction or an aromatic solvent can also be used. Subsequently, the solvent and "paraffinic asphaltenes" are separated from the oil shale. This mixture can be used as combined or it can be separated into fractions and used as hydrogen donor solvents, with or without hydroprocessing. Separated and recovered asphaltenic material can be further processed by cracking or coking. The combined solvent and "paraffinic asphaltenes" mixture can also be contacted with a catalyst for obtaining additional products. Solvent free shale can be either treated by a combustion or a gasification process to make use of residual carbon.

It is therefore an object of this invention to improve the efficiency of oil shale processing, particularly Eastern oil shale processing.

It is a further object of this invention to separate desirable hydrocarbonaceous fractions from oil shale from less desirable hydrocarbonaceous fractions.

It is a yet further object of this present invention to provide for the recovery of more organic products or hydrocarbonaceous materials than are normally obtained by the thermal decomposition of oil shales.

It is still a further object of this invention to provide a method for producing a good quality oil, a fuel source for processing needs, and a separate asphaltene fraction which can be separately processed.

DESCRIPTION OF THE PREFERRED EMBODIMENTS

In the practice of this invention, a hydrogen donor solvent is contacted with oil shale, tar sands, or other similar hydrocarbonaceous materials. The oil shale is prepared by methods known to those skilled in the art to obtain the maximum contact and solubilization for reaction purposes with the oil shale by the hydrogen donor solvent. The oil shale can be either the Devonian black shale of the Eastern United States or oil shale obtained from Western sources such as from the Green River formation. By using this present process, increased yields can be obtained from the Eastern grades of oil shale so as to equal the yields obtained by thermal processing of Western oil shales.

After preparation of the oil shale, a hydrogen donor solvent is contacted with the oil shale under conditions known to those skilled in the art. Generally, these conditions include a temperature of from about 700° to about 950° F., preferably about 800° F. Only autogenous pressure to maintain an H-donor liquid phase is required, which will depend upon the temperature, reactor volume, and choice of solvent. After allowing the hydrogen donor solvent to be in contact with the oil shale for a time of from about 0.5 minutes to about 60 minutes, preferably about 15 minutes, the oil shale is then contacted with a paraffinic solvent.

The paraffinic solvent utilized can be solvents such as propane, butane, pentane, hexane or heptane. Of course, any other similar non polar substantially paraffinic solvent may be utilized so long as it selectively leaves on the oil shale insoluble polar asphaltenic materials. Materials on the oil shale which are insoluble in the solvent utilized are named "asphaltenes." For example, if heptane is used the residual organic material left on the rock will be named "heptane asphaltenes." Should pentane be used, the residual organic material will be named "pentane asphaltenes." Contacting the oil shale with the solvent will result in a liquid comprised of a solvent with soluble hydrocarbonaceous material and a solid comprised of the shale and the generally specified "solvent asphaltenes." As used, the term "solvent asphaltenes" means residual materials which have not dissolved in the utilized paraffinic solvent. As previously mentioned, the "solvent asphaltenes" or "paraffinic asphaltenes" will receive its designation from the particular solvent used. The liquid and solid products of this step may be separated by any conventional means.

The liquid which results from the solvent extraction step may then be hydrogenated. Hydrogenation or hydrogen processing can occur either before or after removal of the paraffinic solvent from the solubilized hydrocarbonaceous material. This removal can be accomplished, for example, by distillation. Hydrocarbonaceous material removed by the solvent from the oil shale and which includes hetroatomic species derived from the shale can be hydrogenated or hydroprocessed alone or in the presence of the paraffinic solvent for use as a hydrogen donor solvent or for additional shale oil products. As is known to those skilled in the art, the very low metals content of the solubilized hydrocarbonaceous material would result in easier hydroprocessing since the low metal content would lead to less contamination of the catalyst utilized.

After removal of the paraffinic solvent and products soluble in it from the oil shale, the shale is next subjected to extraction with a solvent that will selectively dissolve the asphaltenes remaining on the shale. This extraction is conducted at a temperature of from about 75° F. to about 450° F., preferably about 250° F. Pressures of about 15 psig to about 2000 psig, preferably 100–400 psig are generally utilized. These temperatures and pressures are maintained for a time sufficient to solubilize the desired asphaltenes. Solvent choice will depend upon the nature of the residual asphaltenes remaining on the shale. Solvents which can be utilized for this selective extraction step include aromatic solvents such as pyridine, quinoline, and other similar type organic compounds or mixtures containing them. After solublization of the "paraffinic asphaltenes" by one of these selected solvents, the asphaltenes are thus removed from the shale. After this extraction, it is anticipated that little or no hydrocarbonaceous material will remain on the shale. However, for economic considerations, steam stripping of the shale can be included in this process to remove any residual solvent or hydrocarbonaceous material.

After optional steam stripping to remove any residual solvent from the oil shale, some residual carbon that may contain small amounts of H and O, N, or S may remain on the shale. This carbon can be removed by a gasification process or by a combustion process. Both processes are known to those skilled in the art. Utilization of the combustion process results in the residual carbon being used as a fuel. When the gasification process is utilized, the carbon becomes a source of carbon monoxide and hydrogen which can be used in the process of this invention.

Residual asphaltenes or "paraffinic asphaltenes" obtained from the polar solvent extraction of the oil shale by the solvent can be processed in several ways. Both the solvent and "paraffinic asphaltenes" or residual asphaltene mixture can be hydrogenated over a catalyst. Catalysts which can be utilized for this purpose include those commonly known in the art for treating mixtures containing metals and heteroatoms such as oxides or sulfides of Ni, Co, Mo or their mixtures, preferably Co-Mo. As desired, the solvent can be separated and recovered for reuse and recycling into the process. Upon separation of the residual asphaltenes from the solvent, several alternative processing procedures can be utilized. The separated residual asphaltenes can be hydrogenated, cracked, or coked to obtain desired products. Each of these processes is well known to those skilled in the art. Hydrogenated "paraffinic asphaltenes" can be used as a hydrogen donor solvent to solubilize the oil shale in the initial step of the process.

Utilization of this invention results in a good quality oil, a fuel source for the various process needs, and a separate asphaltenes fraction which can be further processed as required. Also, the products resulting from the process steps above can be combined to give the best utilization and combination of hydrocarbonaceous materials produced from the process.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A combination solvent extracting and hydroprocessing process for recovering hydrocarbonaceous materials from oil shale comprising the steps of:

(a) treating said oil shale with a hydrogen donor solvent;

(b) extracting said treated oil shale with a paraffinic solvent which has the ability to solubilize some of the hydrocarbonaceous materials, and to selectively leave on said treated shale, residual asphaltenic materials or "paraffinic asphaltenes", which are insoluble in said solvent;

(c) hydroprocessing said solvent containing said solubilized hydrocarbonaceous material;

(d) extracting said treated oil shale with a solvent suitable for solubilizing said asphaltenes remaining on said treated shale;

(e) hydroprocessing said solvent containing said solubilized asphaltenes; and (f) processing the solvent extracted oil shale to remove any remaining hydrocarbonaceous material therefrom.

2. The process as recited in claim 1 where in step (a) said hydrogen donor solvent comprises the paraffinic solvent and hydrocarbonaceous materials contained therein.

3. The process as recited in claim 1 where in step (a) said hydrogen donor solvent comprises the paraffin solvent and hydrocarbonaceous material which is hydrotreated.

4. The process as recited in claim 1 where in step (b) said paraffinic solvent is pentane.

5. The process as recited in claim 1 where in step (b) said paraffinic solvent is hexane.

6. The process as recited in claim 1 where in step (b) said paraffinic solvent is heptane.

7. The process as recited in claim 1 where in step (d) said solvent is a nitrogen containing polar fraction.

8. The process as recited in claim 1 where in step (d) said solvent is an aromatic compound or mixture.

9. The process as recited in claim 1 where in step (d) said solvent is pyridine.

10. The process as recited in claim 1 where in step (d) said solvent is quinoline.

11. The process as recited in claim 1 where in step (f) said oil shale is steam treated to remove any residual solvent remaining on said oil shale prior to processing to remove residual carbon therefrom.

12. The process as recited in claim 1 where in step (f) the residual carbon is removed from said oil shale by combustion.

13. The process as recited in claim 1 where in step (f) said oil shale containing carbon is subjected to a gasification process which results in the production of process gas which is comprised of carbon monoxide and hydrogen.

14. A combination solvent extracting and hydroprocessing process for recovering hydrocarbonaceous materials from oil shale comprising the steps of:

(a) treating said oil shale with a hydrogen donor solvent;

(b) extracting said treated oil shale with a paraffinic solvent which has the ability to solubilize some of the hydrocarbonaceous materials, and to selectively leave on said treated shale, residual asphaltenic materials or "paraffinic asphaltenes", which are insoluble in said solvent;

(c) separating said solvent from said solubilized hydrocarbonaceous materials;

(d) hydroprocessing at least a portion of said hydrocarbonaceous materials;

(e) extracting said treated oil shale with a solvent suitable for solubilizing said asphaltenes remaining on said treated shale;

(f) hydroprocessing the solvent and said asphaltenes solubilized from said oil shale; and (g) processing said oil shale to remove any remaining carbon therefrom.

15. The process as recited in claim 14 where in step (a) the hydrogen donor solvent comprises the hydrocarbonaceous materials separated from said solvent in step (c) which portion has not been hydroprocessed.

16. The process as recited in claim 14 where in step (a) the hydrogen donor solvent comprises that portion of the hydrocarbonaceous material separated from said solvent in step (c) which has been hydroprocessed.

17. The process as recited in claim 14 where in step (b) the paraffinic solvent is pentane.

18. The process as recited in claim 14 where in step (b) the paraffinic solvent is hexane.

19. The process as recited in claim 14 where in step (b) the paraffinic solvent is heptane.

20. The process as recited in claim 14 where in step (c) said solvent is recycled for further extraction of treated oil shale after separation from the hydrocarbonaceous material.

21. The process as recited in claim 14 where in step (c) separation is accomplished by distillation.

22. The process as recited in claim 14 where in step (e) said solvent is a nitrogen containing polar fraction.

23. The process as recited in claim 14 where in step (e) said solvent is an aromatic compound or mixture.

24. The process as recited in claim 14 where in step (e) said solvent is pyridine.

25. The process as recited in claim 14 where in step (e) said solvent is quinoline.

26. The process as recited in claim 14 where in step (e) said solvent containing said asphaltenes is used as a hydrogen donor solvent in step (a).

27. The process as recited in claim 14 where in step (g) said carbon remaining on said shale is contacted with steam to remove any residual solvent remaining on said oil shale prior to processing to remove residual carbon therefrom.

28. The process as recited in claim 14 where in step (g) said carbon contained on said shale is gasified so as to produce a process gas comprising carbon monoxide and hydrogen.

29. The process as recited in claim 14 where in step (g) the residual carbon is removed from said oil shale by combustion.

30. A combination solvent extracting and hydroprocessing process for recovering hydrocarbonaceous materials from oil shale comprising the steps of:

(a) treating said oil shale with a hydrogen donor solvent;

(b) extracting said treated oil shale with a paraffinic solvent which has the ability to solubilize some of the hydrocarbonaceous materials, and to selectively leave on said treated shale, residual asphaltenic materials or "paraffinic asphaltenes", which are insoluble in said solvent;

(c) separating said solvent from said solubilized hydrocarbonaceous materials;

(d) hydroprocessing at least a portion of said hydrocarbonaceous material;

(e) extracting said treated oil shale with a solvent suitable for solubilizing said asphaltenes remaining on said treated shale;

(f) separating said solvent from said asphaltenes;

(f) hydroprocessing said asphaltenes; and (g) processing said treated oil shale to remove therefrom any remaining carbon.

31. The process as recited in claim 30 where in step (a) said hydrogen donor solvent comprises the paraffinic solvent and hydrocarbonaceous material contained therein.

32. The process as recited in claim 30 where in step (a) said hydrogen donor solvent comprises said paraffinic solvent and said hydroprocessed hydrocarbonaceous material obtained from step (d).

33. The process as recited in claim 30 where in step (a) said hydrogen donor solvent comprises the hydrocarbonaceous materials separated from said solvent in step (c).

34. The process as recited in claim 30 where in step (a) said hydrogen donor solvent comprises said hydrocarbonaceous material separated from said solvent where said hydrocarbonaceous materials are hydroprocessed.

35. The process as recited in claim 30 where in step (a) said hydrogen donor solvent comprises said asphaltenes extracted from said oil shale in step (e).

36. The process as recited in claim 30 where in step (a) said hydrogen donor solvent comprises hydrogenated asphaltenes obtained from step (g).

37. The process as recited in claim 30 where in step (b) the paraffinic solvent in pentane.

38. The process as recited in claim 30 where in step (b) the paraffinic solvent is hexane.

39. The process as recited in claim 30 where in step (b) the paraffinic solvent is heptane.

40. The process as recited in claim 30 where in step (c) said solvent is recycled for further extraction of treated oil shale after separation from the hydrocarbonaceous material.

41. The process as recited in claim 30 where in step (c) separation is accomplished by distillation.

42. The process as recited in claim 30 where in step (e) said solvent is a nitrogen containing polar fraction.

43. The process as recited in claim 30 where in step (e) said solvent is an aromatic compound or mixture.

44. The process as recited in claim 30 where in step (e) said solvent is pyridine.

45. The process as recited in claim 30 where in step (e) said solvent is quinoline.

46. The process as recited in claim 30 where in step (h) said carbon remaining on said shale is contacted with steam to remove any residual solvent remaining on said oil shale prior to processing to remove residual carbon therefrom.

47. The process as recited in claim 30 where in step (h) said carbon contained on said shale is gasified so as to produce a process gas comprising carbon monoxide and hydrogen.

48. The process as recited in claim 30 where in step (h) the carbon is removed from said oil shale by combustion.

* * * * *